US005586726A

United States Patent [19]

Furuya et al.

[11] Patent Number: 5,586,726

[45] Date of Patent: Dec. 24, 1996

[54] COLLISION TYPE FUEL INJECTION NOZZLE AND METHOD OF MANUFACTURING THE NOZZLE

[75] Inventors: Yuji Furuya; Kenichi Iino, both of Higashi-Matsuyama, Japan

[73] Assignee: Zexel Corporation, Japan

[21] Appl. No.: 508,867

[22] Filed: Jul. 28, 1995

[30] Foreign Application Priority Data

Jul. 29, 1994 [JP] Japan ..... 6-196251

[51] Int. Cl.[6] ..... F02M 61/18

[52] U.S. Cl. ..... 239/533.12; 239/544; 239/545; 29/890.142

[58] Field of Search ..... 29/890.142, 890.143, 29/888.46, 558; 239/1, 533.3–533.12, 543–548

[56] References Cited

U.S. PATENT DOCUMENTS

| | | | |
|---|---|---|---|
| 1,230,982 | 6/1917 | Barber | 239/543 |
| 2,318,769 | 5/1943 | Freeman et al. | 29/890.143 |
| 4,177,948 | 12/1979 | Schaffitz et al. | 239/533.3 |
| 4,435,891 | 3/1984 | Nicholson | 29/558 X |
| 5,092,039 | 3/1992 | Gaskell | 29/890.142 |
| 5,193,747 | 3/1993 | Preussner | 239/533.12 X |

FOREIGN PATENT DOCUMENTS

| | | | |
|---|---|---|---|
| 585394 | 10/1959 | Canada | 29/558 |
| 4-125666 | 11/1992 | Japan . | |

*Primary Examiner*—Kevin Weldon

*Attorney, Agent, or Firm*—Ostrolenk, Faber, Gerb & Soffen, LLP

[57] ABSTRACT

A collision type of fuel injection nozzle that ensures full frontal collision between jets of fuel injected from the opposed second injection nozzle holes is provided, and a method of manufacturing the nozzle. The method includes forming fuel inlets that extend from the fuel passage and avoid the collision recess, simultaneously forming the at least one pair of injection nozzles holes in a straight line that intersects the fuel inlets and the collision recess and then fixing a cap over at least a peripheral portion of the injection holes. This manufacturing method permits the nozzle holes to be formed at the same time ensuring alignment of the outlets for collision and highly uniform atomization.

12 Claims, 2 Drawing Sheets

COLLISION TYPE FUEL INJECTION NOZZLE AND METHOD OF MANUFACTURING THE NOZZLE

BACKGROUND OF THE INVENTION

1. Field of the Invention

The present invention relates to a collision type fuel injection nozzle and a method of manufacturing the nozzle, particularly to a collision type fuel injection nozzle that can be manufactured with good precision, and to a method of manufacturing the nozzle.

2. Description of the Prior Art

A drawback with conventional collision type fuel injection nozzles has been the difficulty of machining the nozzle section, which has elevated production costs. A fuel injection nozzle disclosed by JP-A-HEI-4-125666 will be described with reference to FIG. 2. FIG. 2 shows a cross-section of the fuel injection nozzle 1, which has a nozzle body 2, a needle valve 3 and a sleeve 4. Formed in the nozzle body 2 is a fuel reservoir 6, a nozzle sac 7, at least one pair of first injection nozzle holes 8 and one pair of second injection nozzle holes 9, and a collision recess 10 at the tip. The pair of first injection nozzle holes 8 and pair of second injection nozzle holes 9 are joined by connecting portions exposed to the outside which are covered by a sleeve 4.

The needle valve 3 is seated on a seat 11 under a prescribed pressure of a nozzle spring (not shown). A rise in the fuel pressure lifts the needle valve 3 from the seat 11 and allows fuel to be injected at a prescribed pressure into the collision recess 10, via the pair of first injection nozzle holes 8 and pair of second injection nozzle holes 9. The second injection nozzle holes 9 are disposed in mutual opposition in the collision recess 10, so that jets of fuel come from each side of the collision recess 10 and collide with each other, producing a mist which is supplied to a combustion chamber 12.

In order to ensure that the jets of fuel collide with good precision, when the fuel injection nozzle is being manufactured the second injection nozzle holes 9 have to be precisely formed so that the central axes (centers) of the opposed second injection nozzle holes 9 are in alignment. However, in the case of the conventional fuel injection nozzle 1, each of the pair of second injection nozzle holes 9 has to be formed separately, which can give rise to a misalignment of the centers of the second injection nozzle holes 9 that makes it difficult to ensure full collision of the jets of fuel in the collision recess 10, without which it is difficult to obtain a uniformly atomized fuel spray.

SUMMARY OF THE INVENTION

An object of the present invention is to provide a collision type fuel injection nozzle which ensures full frontal collision between jets of fuel injected from the opposed second injection nozzle holes, and a method of manufacturing the nozzle.

Another object of the present invention is to provide a collision type fuel injection nozzle and a method of manufacturing the nozzle in which the precision manufacture of at least one pair of nozzle holes from which the colliding jets of fuel are injected is facilitated.

In accordance with the present invention, the above object is attained by a collision type fuel injection nozzle, comprising a nozzle body in which are formed a fuel passage, a collision recess, fuel inlets in communication with the fuel passage, and at least one pair of injection nozzle holes that communicate with the fuel inlets and open out into the collision recess in opposition to each other, a nozzle element that reciprocates in the nozzle body to inject atomized fuel from the collision recess, and a cap affixed to cover at least a peripheral portion of the injection nozzle holes, wherein the fuel inlets are formed extending from the fuel passage and avoiding the collision recess, and the at least one pair of injection nozzle holes are formed in a straight line to intersect the fuel inlets and the collision recess.

The object is also attained by a method of manufacturing a collision type fuel injection nozzle comprising a nozzle body in which are formed a fuel passage, a collision recess, fuel inlets in communication with the fuel passage, and at least one pair of injection nozzle holes that communicate with the fuel inlets and open out into the collision recess in opposition to each other, and a nozzle element that reciprocates in the nozzle body to inject atomized fuel from the collision recess, the method comprising the steps of forming fuel inlets that extend from the fuel passage and avoid the collision recess, simultaneously forming the at least one pair of injection nozzle holes in a straight line that intersects the fuel inlets and the collision recess, and affixing a cap over at least a peripheral portion of the injection nozzle holes.

In contrast to the conventional arrangement in which each of the pair of injection nozzle holes is formed separately, in accordance with the collision type fuel injection nozzle and method of manufacturing the nozzle of this invention, the pair of injection nozzle holes can be formed integrally at the same time. This enables misalignment between the central axes of the injection nozzle holes to be minimized, which ensures proper frontal collision of the opposed jets of fuel and highly uniform fuel atomization.

Moreover, since the opposed one or more pairs of injection nozzle holes can be integrally and simultaneously formed to intersect the collision recess and fuel inlets, formation of the injection nozzle holes themselves can effected by a manufacturing method that has good precision.

Further features of the invention, its nature and various advantages will become more apparent from the accompanying drawings and following detailed description of the invention.

DESCRIPTION OF THE PREFERRED EMBODIMENT

Figure 1:
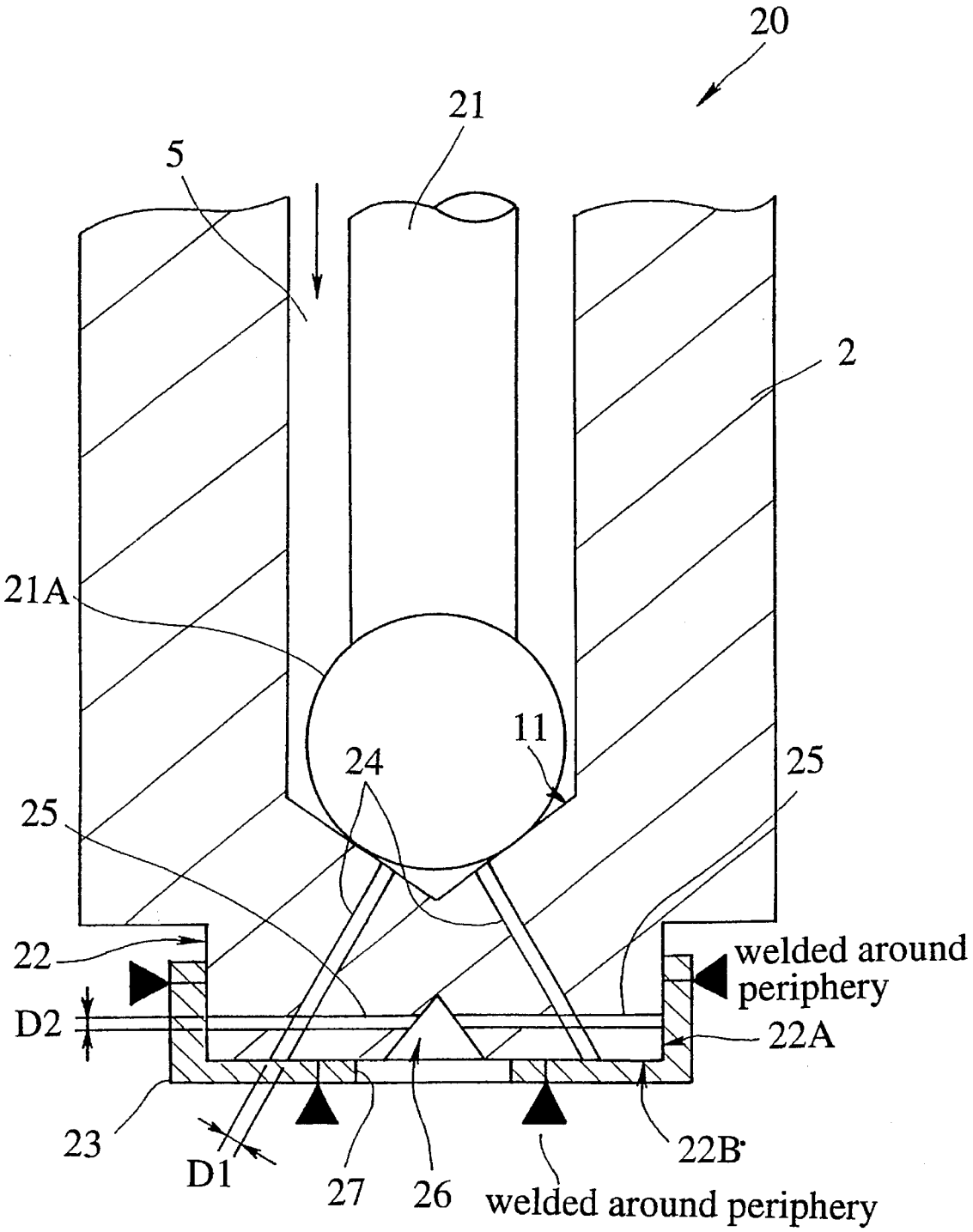
FIG. 1 is a cross-sectional view illustrating an embodiment of the collision type fuel injection nozzle 20 and a method of manufacturing the nozzle according to the present invention.

An embodiment of the collision type fuel injection nozzle and method of manufacturing the nozzle according to the present invention will now be described with reference to FIG. 1. Parts that are the same as those in FIG. 2 have been given identical reference numerals, and further explanation thereof is omitted.

Figure 2:
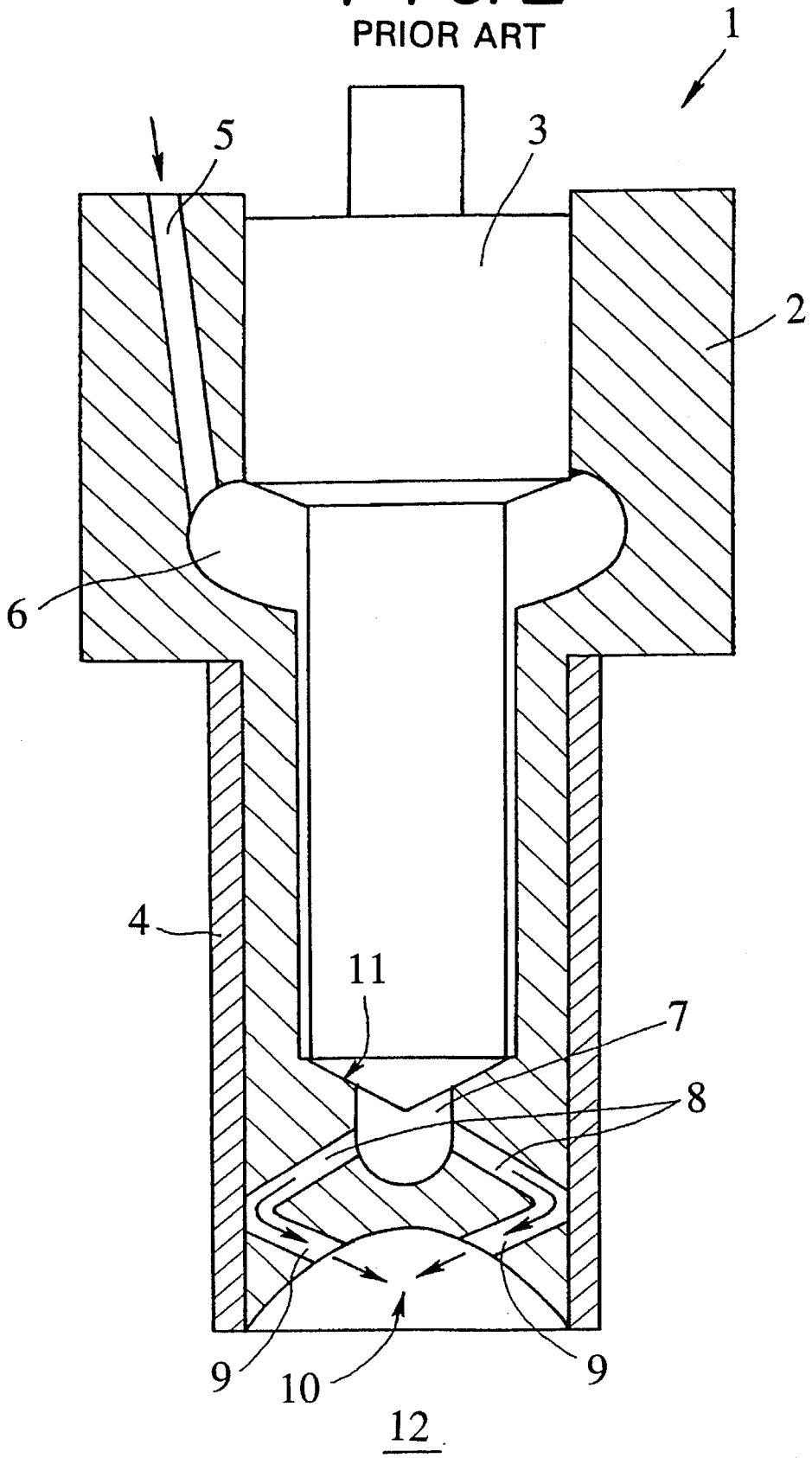
FIG. 2 PRIOR ART
FIG. 2 is a cross-sectional view of a conventional fuel injection nozzle 1 disclosed by JP-A-HEI-4-125666.

FIG. 1 is a cross-sectional view of a collision type fuel injection nozzle 20, which has a nozzle body 2, a valve 21 corresponding to the needle valve 3 of FIG. 2, and a cap 23 fastened onto a tip portion 22 of the nozzle body 2. A ball element 21A of the valve 21 seats on a seat 11. Fuel injection is enabled by lifting the ball element 21A off the seat 11.

At least one pair of fuel inlets 24 are formed in the nozzle tip portion 22 toward the central axis of the seat 11, in communication with a fuel passage 5. Also formed in the nozzle tip portion 22 are at least one pair of injection nozzle holes 25 that intersect the fuel inlets 24, and a collision recess 26 into which the injection nozzle holes 25 open. The fuel inlets 24 extend from the fuel passage 5 portion through to the exterior of the nozzle tip portion 22, avoiding the collision recess 26 (fuel inlet forming process).

The left and right injection nozzle holes 25 are simultaneously formed by drilling or the like through the nozzle tip portion 22 in a straight line that intersects the fuel inlets 24 and passes through the collision recess 26 (nozzle hole forming process). Any number of pairs of fuel inlets 24 and injection nozzle holes 25 may be used provided that the jets of fuel injected from each opposing pair collide head on in the collision recess 26.

If the diameter of each of the fuel inlets 24 is D1 and the diameter of each of the injection nozzle holes 25 is D2, it is desirable that $D2 \leqq D1$. This makes the injection nozzle holes 25, rather than the intersection between the fuel inlets 24 and injection nozzle holes 25, the portion of maximum restriction between the fuel passage 5 and the collision recess 26. Therefore, even if the precision with which the fuel inlets 24 and injection nozzle holes 25 are formed is decreased slightly, the fuel pressure is prevented from decreasing, ensuring the collision of the injected jets of fuel. Also, making the injection nozzle holes 25 the portion of maximum restriction makes it possible to arbitrarily adjust the injection rate by adjusting the size of diameter D2.

While the shape of the collision recess 26 is not particularly limited, there has to be a space above where the jets of fuel injected from the injection nozzle holes 25 collide, that is, on the opposite side to the combustion chamber 12. The angle of spray and spray distribution can be altered as required by designing the shape selectively.

The cap 23, which is constituted of metal, for example, and has an opening 27 that provides communication between the collision recess 26 and the combustion chamber 12, is laser- or arc-welded around the periphery 22A and annular edge portion 22B of the nozzle tip portion 22 (cap affixing process). Thus, the parts where the fuel inlets 24 and injection nozzle holes 25 open to the outside of the nozzle tip portion 22 are sealed closed by the cap 23. As such, if the fuel inlets 24 are not formed as through holes, it is not necessary to cover the annular edge portion 22B. For securely preventing the leakage of fuel from the fuel inlets 24 and injection nozzle holes 25 it is preferable to weld above the openings, with reference to the drawing, and on the opening 27 side.

In this collision type fuel injection nozzle 20, when the valve 21 (ball element 21A) is lifted from the seat 11 by an increase in the pressure of fuel coming from the fuel passage 5, fuel passes through the fuel inlets 24 and the injection nozzle holes 25 in communication with the fuel inlets 24, and jets into the collision recess 26 from each side. The resulting collision of the jets atomizes the fuel into a uniform mist that is supplied to the combustion chamber 12.

Compared to the conventional manufacturing method, it is far easier to manufacture this collision type fuel injection nozzle 20 with the axes of the injection nozzle holes 25 in alignment, so production efficiency can be improved and costs reduced. The arrangement and position of the intersections between the fuel inlets 24 and the injection nozzle holes 25 can be arbitrarily decided. The internal configuration of the nozzle body 2 is also arbitrary, with the nozzle being the type described above or an electronically controlled injector. Also, a ball valve or valve seat may be used may be used instead of the conventional needle valve 3 of FIG. 2.

As described in the foregoing, in accordance with this invention, opposed injection nozzle holes can be integrally formed on each side of a collision recess by drilling or the like. This provides high-precision collision of the jets of fuel, decreases manufacturing costs, reduces non-uniformity of the atomized fuel, and ensures that a spray is obtained having the small penetration and spray particle size that are a feature of a collision type fuel injection nozzle.

What is claimed is:

1. A collision type fuel injection nozzle comprising:

a nozzle body in which are formed a fuel passage, a collision recess, fuel inlets in communication with the fuel passage, and at least one pair of injection nozzle holes that communicate with the fuel inlets and open out into the collision recess in opposition to each other, a nozzle element that reciprocates in the nozzle body to inject atomized fuel from the collision recess, and a cap affixed to cover at least a peripheral portion of the injection nozzle holes, wherein the fuel inlets are formed extending from the fuel passage and avoiding the collision recess and the at least one pair of injection nozzle holes are formed in a straight line to intersect the fuel inlets and the collision recess.

2. A collision type fuel injection nozzle according to claim 1 wherein fuel inlet diameter is equal to or greater than injection nozzle hole diameter.

3. A collision type fuel injection nozzle according to claim 1 wherein the injection nozzle holes are formed in a diametrical direction with respect to the nozzle body.

4. A collision type fuel injection nozzle according to claim 1 wherein the injection nozzle holes are formed perpendicularly to a lengthwise direction of the nozzle body.

5. A collision type fuel injection nozzle according to claim 1 wherein a seat on which the nozzle element seats is formed in the nozzle body and the fuel passage and the fuel inlets can be communicated by lifting the nozzle element from the seat.

6. A collision type fuel injection nozzle according to claim 5 wherein the openings of the fuel inlets are formed on the axis side of the seat.

7. A collision type fuel injection nozzle according to claim 1 wherein formed on the nozzle body is a nozzle tip portion in which are formed the fuel inlets, injection nozzle holes, and collision recess.

8. A collision type fuel injection nozzle according to claim 7 wherein the cap is affixed to the nozzle tip portion.

9. A collision type fuel injection nozzle according to claim 7 wherein the cap is welded around the periphery and annular edge portion of the nozzle tip portion.

10. A collision type fuel injection nozzle according to claim 1 wherein the cap has an opening that provides communication between the collision recess and the combustion chamber.

11. A method of manufacturing a collision type fuel injection nozzle comprising a nozzle body in which are formed a fuel passage, a collision recess, fuel inlets in communication with the fuel passage, and at least one pair of injection nozzle holes that communicate with the fuel inlets and open out into the collision recess in opposition to each other, and a nozzle element that reciprocates in the nozzle body to inject atomized fuel from the collision recess the method comprising the steps of forming fuel inlets that extend from the fuel passage and avoid the collision recess, simultaneously forming the at least one pair of injection nozzle holes in a straight line that intersects the fuel inlets and the collision recess, and affixing a cap over at least a peripheral portion of the injection nozzle holes.

12. A method of manufacturing a collision type fuel injection nozzle according to claim 11 wherein the pair of injection nozzle holes is formed from the outside portion at one side of the nozzle body, through the collision recess to the outside portion at the other side of the nozzle body.

* * * * *